US007428799B1

(12) United States Patent
Frelier

(10) Patent No.: US 7,428,799 B1
(45) Date of Patent: Sep. 30, 2008

(54) GUTTER DRAINAGE AND DEBRIS REMOVAL SYSTEM

(76) Inventor: Calvin Frelier, 15 Old Westfall Dr., Rochester, NY (US) 14625

( * ) Notice: Subject to any disclaimer, the term of this patent is extended or adjusted under 35 U.S.C. 154(b) by 0 days.

(21) Appl. No.: 11/807,966

(22) Filed: Jun. 1, 2007

(51) Int. Cl.
*E04D 13/00* (2006.01)

(52) U.S. Cl. ..... 52/11; 52/12; 52/13; 52/14; 52/15; 52/16; 15/236.04; 15/1; 401/289

(58) Field of Classification Search ..... 52/11–16; 15/1, 236.04; 401/289
See application file for complete search history.

(56) References Cited

U.S. PATENT DOCUMENTS 2,910,711 A * 11/1959 Mizelle ..... 401/48
3,007,662 A * 11/1961 Featheringham ..... 248/48.2
3,023,971 A * 3/1962 Milhous ..... 401/137
3,740,787 A * 6/1973 Bowermaster ..... 15/105
4,309,792 A * 1/1982 Faye ..... 16/389
4,745,657 A * 5/1988 Faye ..... 16/226
4,750,883 A * 6/1988 Drake ..... 401/137
4,978,241 A * 12/1990 Lawson ..... 401/118
5,274,965 A * 1/1994 Jackson ..... 52/11
5,357,719 A * 10/1994 Lewis ..... 52/11
5,638,643 A * 6/1997 Demartini et al. ..... 52/11
5,649,681 A * 7/1997 Faye ..... 248/48.1
5,802,774 A * 9/1998 Kardacz ..... 52/11
5,867,945 A * 2/1999 Scafidi ..... 52/16
6,964,135 B1 * 11/2005 Slodov ..... 52/11
7,152,376 B2 * 12/2006 Wyatt ..... 52/11
2004/0060142 A1 * 4/2004 Hubbard ..... 15/236.04
2004/0178303 A1 * 9/2004 Hardin ..... 248/48.1

* cited by examiner

*Primary Examiner*—Brian Glessner
*Assistant Examiner*—James J Buckle, Jr.
(74) *Attorney, Agent, or Firm*—Robert J. Bird

(57) ABSTRACT

A rain gutter includes a back wall, bottom member, and front wall, forming an elongated channel. The front wall is pivotally connected along the bottom member for forward movement between an upstanding position and a downward open position. An upright scavenger blade mounted in and along the channel is movable between a retracted position and a forward position to push the front wall open and dump the gutter contents. The scavenger blade includes a flexible wiper along its bottom to slide across the channel bottom. The system is actuated by a piston which reciprocates the scavenger blade across the channel, between retracted and extended positions. The actuator system also includes a base plate parallel to the back wall, a channel span parallel to the base plate, and parallel hinge plates connecting the base plate and channel span, all together forming a four-bar linkage. An actuator arm is pivotally connected at one end to the base plate, and slidably connected at its other end to the channel span. The piston actuator is pivotally connected at one end to the base plate and at its other end to an intermediate point of the actuator arm. The scavenger blade is so mounted to the channel span as to allow to blade to retain its lengthwise position in the channel independent of movement of the channel span.

10 Claims, 5 Drawing Sheets

GUTTER DRAINAGE AND DEBRIS REMOVAL SYSTEM

BACKGROUND INFORMATION

This invention is a rain gutter system, and more specifically a rain gutter system with means to eject accumulated debris from the gutter.

Conventional rain gutter systems include generally horizontal gutters to collect water from a roof surface, and vertical downspouts to drain water from the gutters to the ground below. A problem with such gutters is that they also accumulate debris such as leaves, seeds, needles, cones, and the like. These accumulations must be removed from time to time, and this is typically done manually by someone standing on a ladder.

U.S. Pat. No. 7,152,376 issued Dec. 26, 2006 to Wyatt discloses a rain gutter system in which gutters are tiltable forward to dump accumulated debris. Wyatt is the most relevant prior art that I know of.

SUMMARY OF THE INVENTION

This invention is a rain gutter including a back wall, bottom member, and front wall, forming an elongated channel. The front wall is pivotally connected along the bottom member for forward movement between an upstanding position and a downward open position. An upright scavenger blade mounted in and along the channel is movable between a retracted position and a forward position to push the front wall open and dump the gutter contents. The scavenger blade includes a flexible wiper along its bottom to slide across the channel bottom. The system is actuated by a piston which reciprocates the scavenger blade across the channel, between retracted and extended positions. The actuator system also includes a base plate parallel to the back wall, a channel span parallel to the base plate, and parallel hinge plates connecting the base plate and channel span, all together forming a four-bar linkage. An actuator arm is pivotally connected at one end to the base plate, and slidably connected at its other end to the channel span. The piston actuator is pivotally connected at one end to the base plate and at its other end to an intermediate point of the actuator arm. The scavenger blade is so mounted to the channel span as to allow to blade to retain its lengthwise position in the channel independent of movement of the channel span.

DESCRIPTION OF THE INVENTION

Figure 1:
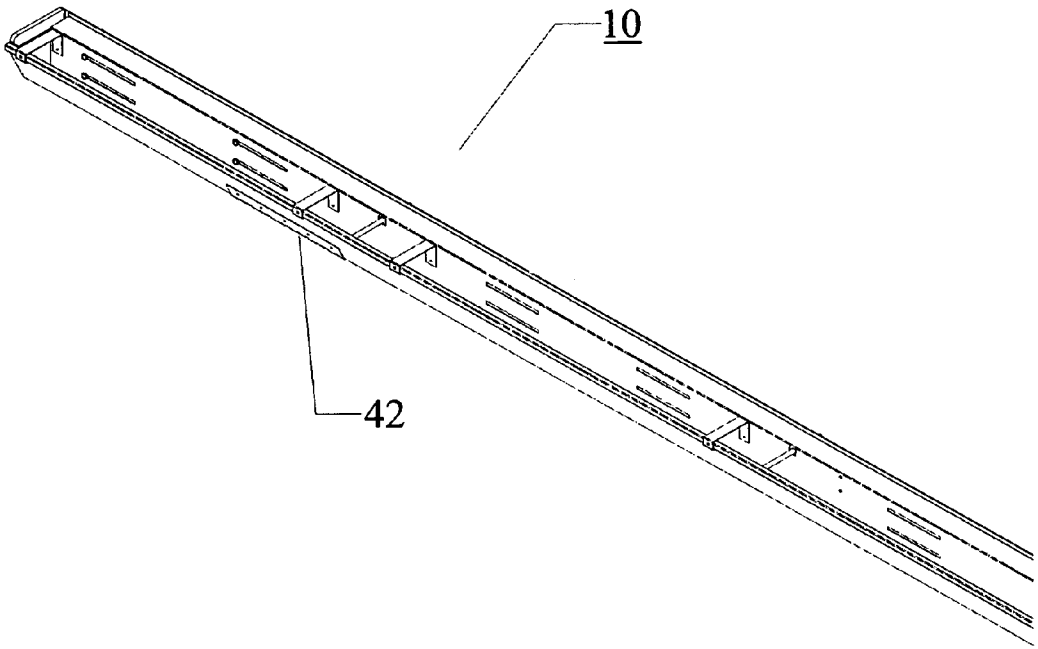
FIG. 1 is right front perspective view of my drainage and debris removal system.

With reference now to the drawing figures:

FIG. 1 shows an integrated drainage and debris removal system 10. The system 10 is intended for mounting to a house or builing (not shown), typically at the bottom of a sloped roof to collect and conduct rainwater away from the structure and its foundation.

A roof drainage system tends to collect and accumulate within the drainage channel debris from the roof. Reliable function of the gutter requires periodic clearing of debris to eliminate clogging.

Figure 2:
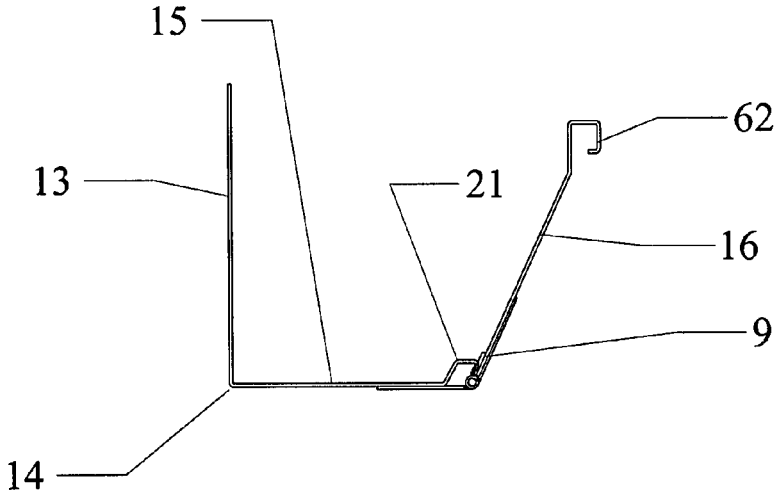
FIG. 2 is a side view of the interior of the gutter of this system.
Figure 3:
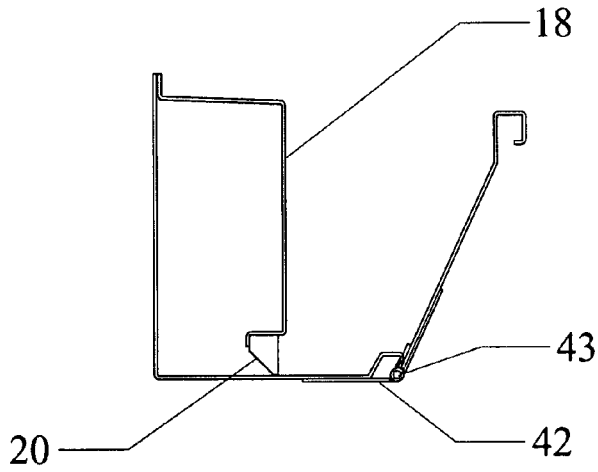
FIG. 3 is a side view of a scavenger blade in the gutter.
Figure 4:
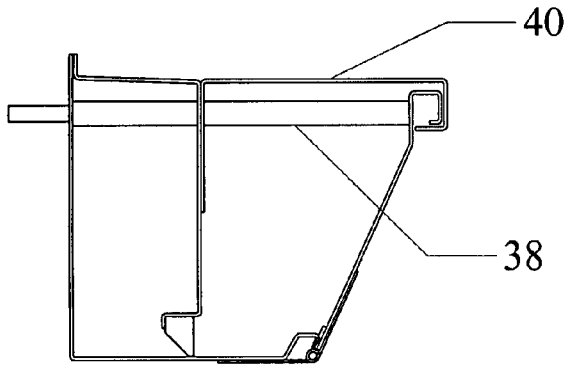
FIG. 4 is a side view of a door stop, retainer, and scavenger blade in the gutter.

The system, best seen in FIGS. 2-4, includes a front gutter door 16, flexible seal 9, and a rear gutter section 14 consisting of a back wall 13 and bottom 15. The rear gutter section 14 is approximately 4.7" tall, 3.7" wide, made of aluminum, and includes a hooked feature 21. The rear gutter section 14 is fixed to supporting structure by fasteners 80 (FIG. 6) at regular intervals running through the back wall 13 of the rear gutter section 14.

Gutters may be formed in continuous process from a roll to match required lengths, or gutter sections may be formed in fixed lengths, and abutted and sealed at their joints.

A spring hinge 42 is fixed to the rear gutter 14. The spring hinge 42 is preferably of stainless steel but might instead be of aluminum. The hinge 42 includes a hinge pin 43. Fully opened, the spring hinge 42 is approximately 3 inches wide by 12 inches long, and provides 5 inch-lbs of torque. Torsion spring 41 and hinge pin 43 are of stainless steel.

The front gutter door 16 is fixed to the spring hinge 42 and is approximately equal in length to the matching rear gutter. Front gutter door 16 is made of aluminum and has an overall height of about 4". The front gutter door 16 has a box structure 62 at one end to increase structural rigidity for strength to support loads such as ladders without damage to the overall system.

A flexible seal 9 is fixed to the lower lip of the front gutter door 16 by an acrylic adhesive. The seal 9 is preferably silicone rubber tape in roll form, about 1/16" thick and 3/8" wide. Seal 9 is also fixed to the ends of the front gutter door to aid in sealing the interface (not shown) between the end cap 22 (FIG. 10) and front gutter door 16.

An end cap 22 is fixed to the rear gutter 14 at each end. End cap 22, of aluminum, has a profile to match the rear and front gutters 14 and 16 where gutters and ends meet.

Figure 5:
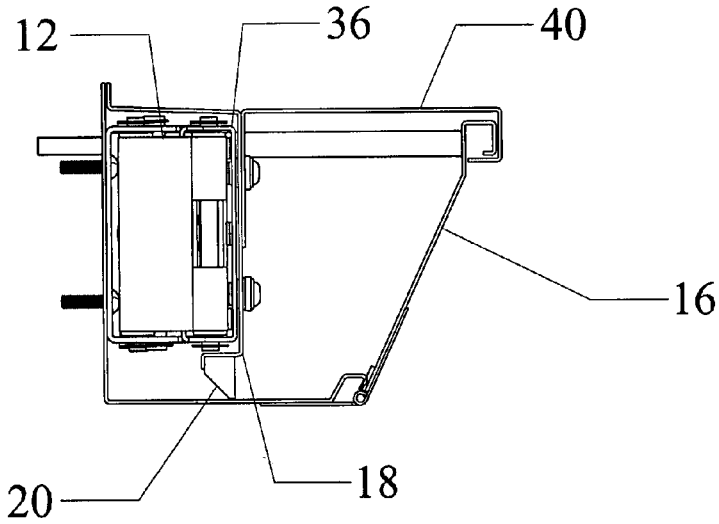
FIG. 5 is a side view of the gutter system in its normally closed position.
Figure 6:
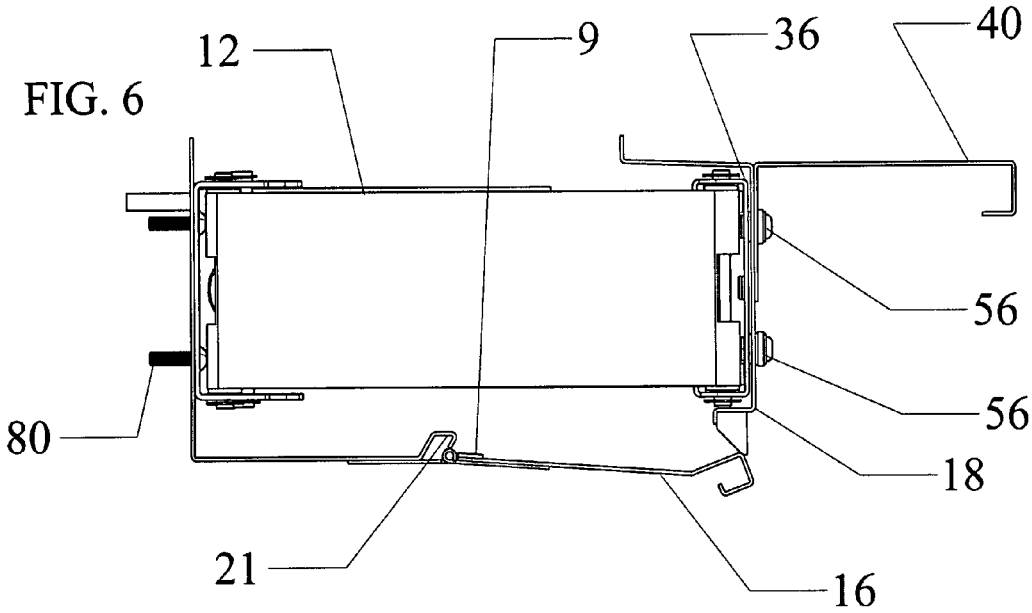
FIG. 6 is a side view of the gutter system in its open position.

In FIGS. 5 and 6, a scavenger blade 18 is loosely fixed to the channel span 36 by multiple standoff features 56 which allow relative translation between itself and channel span 36. Scavenger blade 18 is made of aluminum, approximately 0.05" thick, with approximate height 4.25" and depth 1.9". Scavenger blade 18 includes slots 58 (FIG. 10) to support the blade 18 to allow translation of the underlying channel span 36 relative to the blade 18 during actuation of the actuation assembly 12.

Figure 10:
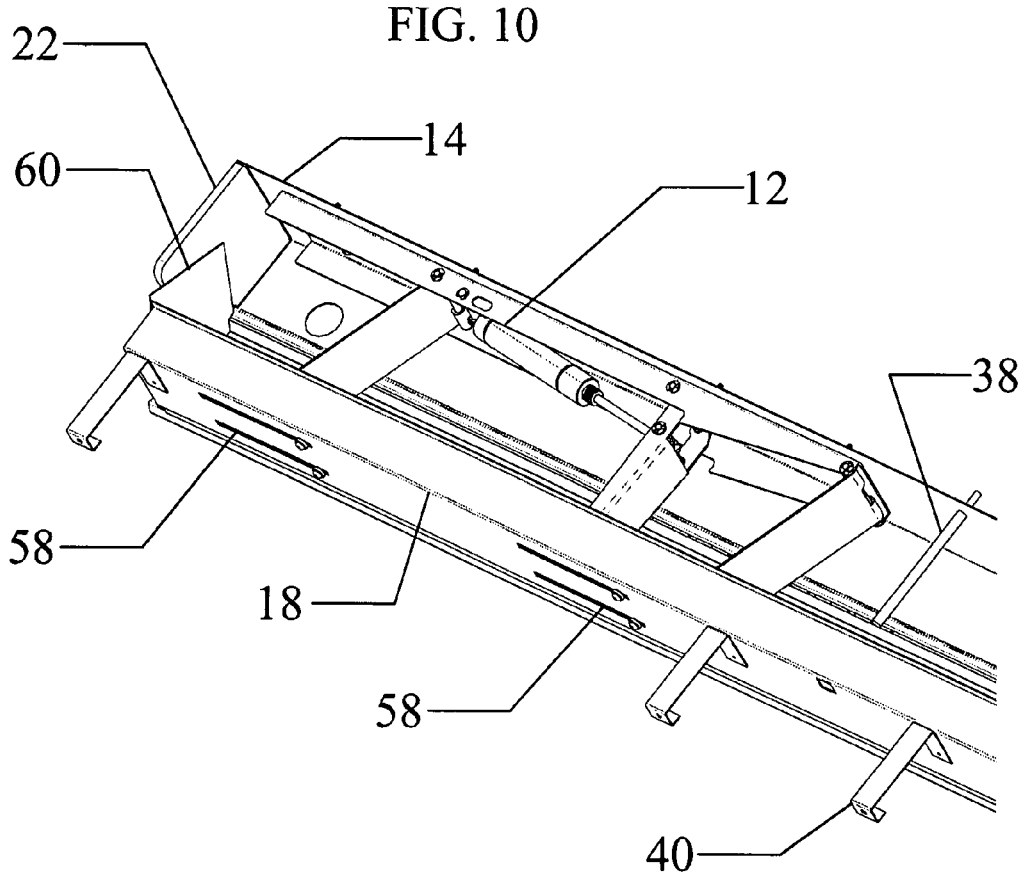
FIG. 10 is a perspective view from the right end of the gutter system in its open position.

In FIG. 10 a retaining plate 60 is suitably fixed to the front gutter door 16 to move with the front door during debris ejection cycle. Slots 58 allow relative translation between actuation assembly 12 and scavenger blade 18. Retaining plate 60 placed at extreme ends of drainage system and fixed to front gutter door 16 effect the scavenging blade 18 to travel in a direction substantially perpendicular to the longitudinal axis of the overall drainage system and parallel to the face of retaining plate 60 during system actuation.

Actuation assembly 12 is mounterd to the rear gutter 14 and to supporting fascia board (not shown). Plural actuation assemblies are intended to be mounted along a building structure, and care is required to mount them in proper alignment.

Figure 7:
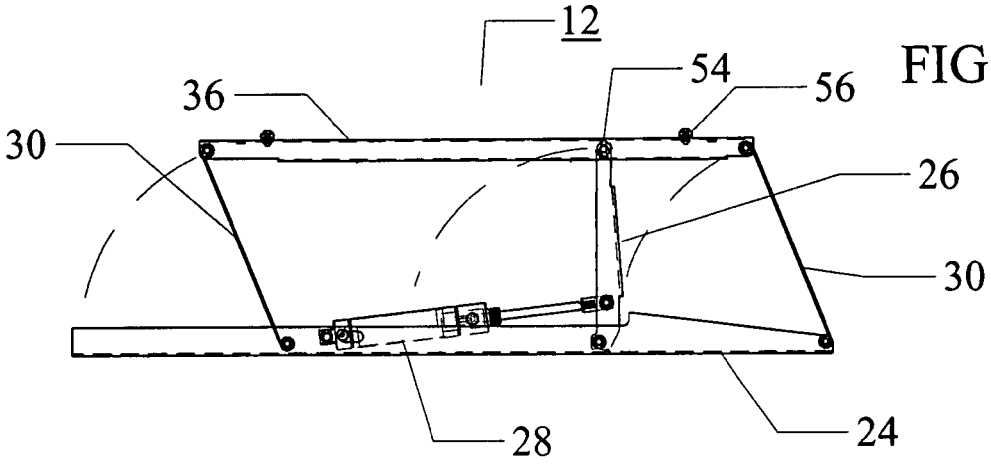
FIG. 7 is a top view of an actuator assembly.
Figure 8:
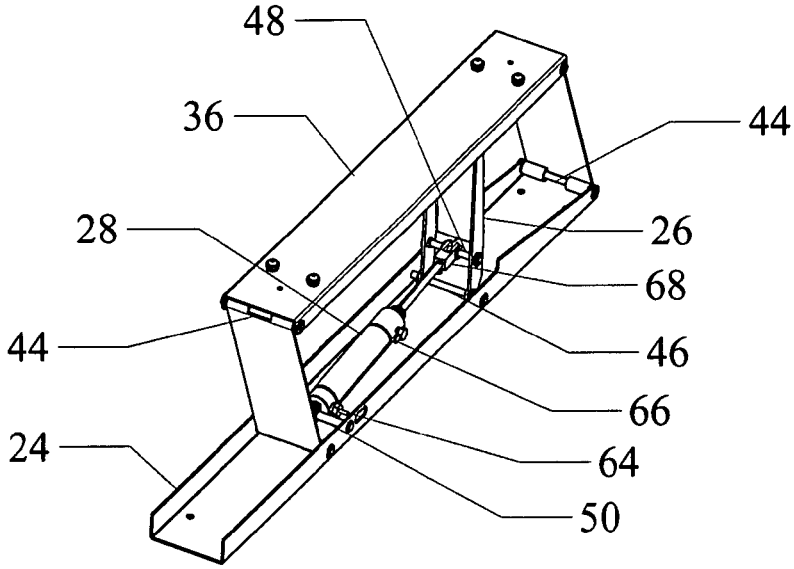
FIG. 8 is a perspective view looking in on an actuator assembly.
Figure 9:
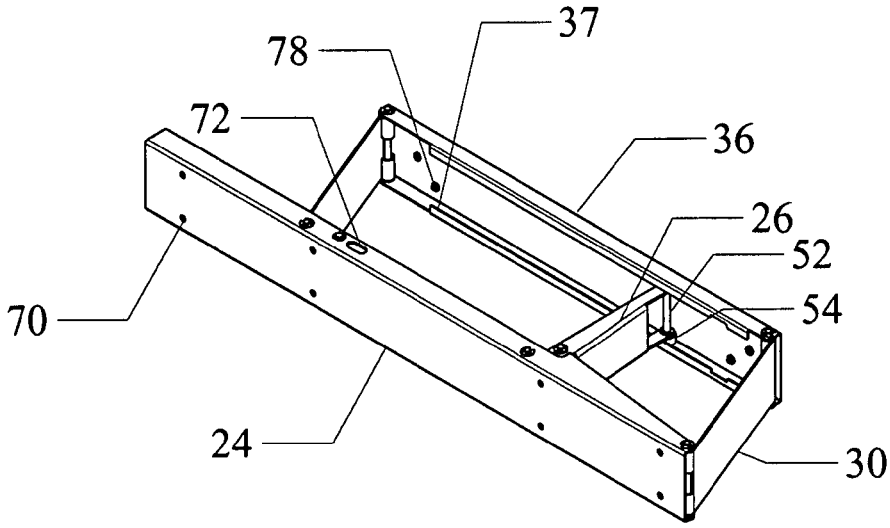
FIG. 9 is a perspective view from behind and above an actuator assembly.

Referring to FIGS. 7-9, the actuation assembly 12 includes an actuator base plate 24 made of aluminum plate, approximately 0.08" thick and approximately 30 inches long with upward formed sides approximately 1" high and 24" long. The remaining six inches of length of upward formed sides rise to a height of approximately 1.5" and decline at an angle of 7° toward the end of the actuator base plate 24. Holes in the sidewalls of the actuator base plate accommodate bearings and shafts.

Channel span 36 is made of aluminum plate, approximately 0.06" thick, with a formed channel 37 running along the length on both sides. Channels 37 form a path for the orbital actuation roller 54. The channel span 36 is approximately 21.3" long and 3.1" wide with channel sections approximately 0.7" across in cross section. Hinge plate 30 is made of stainless steel plate, approximately 0.07" thick, with rolled ends similar to typical door hinge. Each end of hinge plate 30 has a rolled end. Hinge plate 30 is approximately 8" long and 3" wide. Actuation Arm 26, is constructed of aluminum, approximately 0.1" thick, and includes a central smaller plate and two longer formed sides extending from the plate at 90°. Actuation arm 16 is approximately 7.6" long, 2.2" wide, and 1.2" high.

Air cylinder or a reciprocable expansible chamber device 28 is primarily stainless steel and aluminum and is approximately 1.125" diameter with a 3" stroke. Air cylinder 28 in the actuation assembly 12 motivates debris removal from the system. Air cylinder 28 drives the actuation assembly open or closed depending on which end of the cylinder is pressurized. The rod end of the air cylinder 12 includes a rod clevis 68 to connect the pneumatic acting shaft 48 to actuation arm 26.

An air hose or line (not shown) is routed to the actuation assembly 12 and enters through an opening 72 in the sidewall of the actuator base plate 24. Plural air lines are connected in series when more than one actuation assembly 12 is employed. Accordingly, two series of connected air lines linking all of the actuation assemblies in a given drainage system will exist; one to actuate the removal process, and one to return or close the system after debris has been dumped.

This system might be driven by electric or hydraulic means instead of the pneumatic system described above. Also, replacing constructing hinge plate 30 out of perforated stock and replacing end cap 22 with an enclosed angled channel multiple devices can be placed around continuous perimeters of roof sections set at different angles.

PARTS LIST

The following is a list of structural elements and reference numbers in the drawing.

| | |
|---|---|
| 9 | Flexible seal |
| 10 | Gutter Drainage and Debris Removal System |
| 12 | Actuation Assembly |
| 13 | Back Wall |
| 14 | Rear Gutter |
| 15 | Bottom |
| 16 | Front Gutter Door |
| 18 | Scavenging Blade |
| 20 | Wiper |
| 21 | Hooked Feature |
| 22 | End Cap |
| 24 | Actuator Base Plate |
| 26 | Actuation Arm |
| 28 | Air Cylinder |

-continued

| | |
|---|---|
| 30 | Hinge Plate |
| 36 | Channel Span |
| 37 | Formed Channel |
| 38 | Door Stop |
| 40 | Gutter Retainer |
| 42 | Spring Hinge |
| 43 | Pin |
| 44 | Shaft, Hinge Plate |
| 46 | Shaft, Actuation Arm |
| 48 | Shaft, Pneumatic Acting |
| 50 | Shaft, Pneumatic Reaction Fixed |
| 52 | Orbital Shaft |
| 54 | Orbital Actuation Roller |
| 56 | Standoff feature |
| 58 | Slot |
| 60 | Retaining plate |
| 62 | Box structure |
| 64 | Straight Fitting, Air Cylinder |
| 66 | Elbow Fixed Fitting, Air Cylinder |
| 68 | Rod Clevis |
| 70 | Hole |
| 72 | Opening for air hose |
| 78 | Nut, Pemsert |
| 80 | Fastener |

In the following claims, any terms indicative of orientation (e.g. front, back; left, right; upper, lower; top, bottom; horizontal, vertical) are intended to correspond with the invention as illustrated to facilitate an understanding of the invention. Such terms are not to be interpreted as positive limitations.

The foregoing description is illustrative of a preferred embodiment of this invention. The concept and scope of the invention are limited not by the details of that description but only by the purview of the following claims.

What is claimed is:

1. A rain gutter including a back wall, bottom member, and front wall, together forming an elongated channel;

said front wall being lengthwise pivotally connected to said bottom member for pivotal movement between an upstanding closed position and a downward open position, said front wall being spring-biased toward said closed position;

an upright scavenger blade disposed within and along said channel for movement between a home position retracted toward said back wall and an extended position against said front wall to effect pivotal movement thereof downward to said open position, said scavenger blade including a resilient wiper blade along the bottom thereof for wiping engagement with said bottom member whereby to expel debris from said gutter, and;

actuator means to move said scavenger blade between said home position and said extended position thereof.

2. A rain gutter as defined in claim 1; said actuator means including a reciprocable expansible chamber device disposed between, and operatively connected to, said back wall and said scavenger blade.

3. A rain gutter as defined in claim 1; further including a seal strip along the lower portion of said front wall for sealing engagement with said bottom member along the length thereof when said front wall is in said closed position.

4. A rain gutter as defined in claim 3; said bottom member including an outer lip along the length thereof, said outer lip including an upturned dam forming a shallow channel along said bottom member and a downturned flange for area contact with said seal strip when said front wall is in said closed position.

5. A rain gutter as defined in claim 1; said front wall including an upper box section along the length thereof, and said scavenger blade including a forward extending retainer having a hooked outer end to capture said upper box section of said front wall when said front wall is in said closed position.

6. A rain gutter as defined in claim 1; further including a positive stop against movement of said front wall inward of said closed position.

7. A rain gutter including a back wall, bottom member, and front wall, together forming an elongated channel;

said front wall being lengthwise pivotally connected to said bottom member for pivotal movement between an upstanding closed position and a downward open position, said front wall being spring-biased toward said closed position;

an upright scavenger blade disposed within and along said channel for movement between a home position retracted toward said back wall and an extended position against said front wall to effect pivotal movement thereof downward to said open position, said scavenger blade including a resilient wiper blade along the bottom thereof for wiping engagement with said bottom member whereby to expel debris from said gutter, and;

actuator means including a reciprocable expansible chamber device disposed between said back wall and said scavenger blade to move said scavenger blade between said home position and said extended position thereof, said scavenger blade being lengthwise slidably connected to said actuator means to thereby allow said blade to retain the position thereof lengthwise along said channel.

8. A rain gutter as defined in claim 7; further including an end cap on an outer end of said front wall.

9. A rain gutter including a back wall, bottom member, and front wall, together forming an elongated channel;

said front wall being lengthwise pivotally connected to said bottom member for pivotal movement between an upstanding closed position and a downward open position, said front wall being spring-biased toward said closed position;

an upright scavenger blade disposed within and along said channel for movement between a home position retracted toward said back wall and an extended position against said front wall to effect pivotal movement thereof downward to said open position, said scavenger blade including a resilient wiper blade along the bottom thereof for wiping engagement with said bottom member whereby to expel debris from said gutter, and;

actuator means including a reciprocable expansible chamber device disposed between said back wall and said scavenger blade to move said scavenger blade between said home position and said extended position thereof, said scavenger blade being lengthwise slidably connected to said actuator means to thereby allow said blade to retain the position thereof lengthwise along said channel;

said actuator means further including a base plate parallel to said back wall, a channel span parallel to said base plate, and parallel hinge plates connecting said base plate and said channel span, said parallel members together forming a four-bar linkage, said expansible chamber device operatively connected between said base plate and said channel span to move said channel span across said channel relative to said base plate.

10. A rain gutter as defined in claim 9; said actuator means further including an actuator arm pivotally connected at one end thereof to said base plate, slidably connected at the other end thereof to said channel span, and pivotally connected at an intermediate point thereof to said expansible chamber device.

* * * * *